United States Patent [19]

Mifune et al.

[11] Patent Number: 4,681,838

[45] Date of Patent: Jul. 21, 1987

[54] SILVER HALIDE PHOTOGRAPHIC EMULSION AND PROCESS FOR PRODUCTION THEREOF

[75] Inventors: Hiroyuki Mifune; Tadao Shishido; Yoshiaki Suzuki, all of Kanagawa, Japan

[73] Assignee: Fuji Photo Film Co., Ltd., Kanagawa, Japan

[21] Appl. No.: 744,595

[22] Filed: Jun. 14, 1985

[30] Foreign Application Priority Data

Jun. 15, 1984 [JP] Japan ..... 59-122984

[51] Int. Cl.[4] ..... G03C 1/08; G03C 1/34; G03C 1/02

[52] U.S. Cl. ..... 430/367; 430/569; 430/608; 430/599; 430/943

[58] Field of Search ..... 430/599, 608, 621, 569, 430/943, 567

[56] References Cited

U.S. PATENT DOCUMENTS

| | | | |
|---|---|---|---|
| 2,618,556 | 11/1952 | Hewitson et al. | 430/569 |
| 3,957,490 | 5/1976 | Libeer et al. | 430/569 |
| 4,439,520 | 3/1984 | Kofron et al. | 430/567 |

*Primary Examiner*—Richard L. Schilling
*Attorney, Agent, or Firm*—Sughrue, Mion, Zinn, Macpeak & Seas

[57] ABSTRACT

A silver halide emulsion and a process for producing the same are disclosed. In the process, at least one compound selected from hydrogen peroxide or an adduct or precursor thereof, a peroxy acid salt, and ozone is added to an emulsion in the step prior to the end of chemical ripening. The emulsion exhibits reduced fog, improved stability with time, and improved sensitivity.

33 Claims, No Drawings

SILVER HALIDE PHOTOGRAPHIC EMULSION AND PROCESS FOR PRODUCTION THEREOF

FIELD OF THE INVENTION

This invention relates to a silver halide photographic emulsion, and more particularly to a silver halide photographic emulsion which is substantially of a surface latent image type, having improved fog, stability with time, and sensitivity.

BACKGROUND OF THE INVENTION

Silver halide emulsions of surface latent image type are widely employed in photographic light-sensitive materials and photographic papers.

The surface latent image type silver halide emulsions are usually sensitized by chemical sensitization with sulfur sensitizers, noble metal sensitizers, and the like. However, chemical sensitization for imparting higher sensitivity to surface latent image type silver halide emulsions often raises problems, such as that increased fog results on development, or that fog increases with the passage of time before use after the emulsion is coated on a support. Such tendency is particularly conspicuous when the grain size of the silver halide crystals is increased for obtaining a silver halide emulsion having enhanced sensitivity.

In order to overcome these disadvantages, various additives have hitherto been proposed. For example, a method is known for stabilizing a silver halide emulsion by restraining fog through use of potassium ferricyanide in the precipitation step or physical ripening step, as disclosed in Japanese Patent Application (OPI) No. 1835/72 (the term "OPI" as herein used means "unexamined published application").

Further, Japanese Patent Publication Nos. 41056/76 and 56855/83 disclose a method for inhibiting fog and thus stabilizing a silver halide emulsion by using an organic halogen compound in the chemical ripening step.

Furthermore, East German Pat. No. 7376 describes a method of inhibiting fog by adding a thiosulfonate, exemplified by sodium benzenethiosulfonate, to an emulsion during chemical ripening or by the time immediately before coating.

Although use of the above-described additives, such as potassium ferricyanide, organic halogen compounds, and thiosulfonates has succeeded in inhibiting fog or increases in fog over time, the latent image that is formed by exposure of a photographic light-sensitive material to light is unavoidably oxidized when left to stand for a long time until development, e.g., for a period of from several days to several months, and, as a result, development of such as exposed material forms an inferior image. This phenomenon is generally called fading of the latent image.

In addition, use of potassium ferricyanide as conventionally proposed gives rise to an environmental pollution problem.

Accordingly, development of a surface latent image type silver halide emulsion free from the above-described disadvantages has been strongly desired.

SUMMARY OF THE INVENTION

An object of this invention is to provide a silver halide emulsion, which is substantially of a surface latent image type, having markedly restrained fog, improved stability with time, and improved sensitivity without being accompanied by deterioration of photographic properties, such as fading of the latent image, and a process for producing the same.

Another object of this invention is to provide a silver halide emulsion, which is substantially of a surface latent image type, wherein an additive free from an environmental pollution is employed, and a process for producing the same.

As a result of extensive investigations, it has now been found that the above-described objects can be accomplished by a process for producing a substantially surface latent image type silver halide emulsion including conducting precipitation, physical ripening, washing, and chemical ripening steps, in which at least one compound selected from hydrogen peroxide or an adduct or precursor thereof, a peroxy acid salt, and ozone is added to an emulsion in the step prior to the end of the chemical ripening step.

DETAILED DESCRIPTION OF THE INVENTION

The expression "substantially surface latent image type" as used throughout the specification and claims means that when a silver halide emulsion is exposed for from 1 to 1/100 second and developed by the following surface development (A) and internal development (B), the sensitivity obtained by the surface development (A) is greater than that obtained by the internal development (B). The term "sensitivity" as herein referred to is defined as follows:

$$S=100/EH$$

wherein S represents a sensitivity; and Eh represents an exposure required for obtaining an intermediate density between a maximum density (Dmax) and a minimum density (Dmin), i.e., $\frac{1}{2}$(Dmax+Dmin).

SURFACE DEVELOPMENT (A)

Development is carried out at a temperature of 20° C. for 10 minutes in a developing solution having the following composition:

| | |
|---|---|
| N—Methyl-p-aminophenol (hemisulfate) | 2.5 g |
| Ascorbic acid | 10 g |
| Sodium metaborate tetrahydrate | 35 g |
| Potassium bromide | 1 g |
| Water to make | 1 liter |

INTERNAL DEVELOPMENT (B)

A material is processed in a bleaching solution containing 3 g/l of potassium ferricyanide and 0.0125 g/l of phenosafranine at about 20° C. for 10 minutes. After washing with water for 10 minutes, the material is developed at 20° C. for 10 minutes in a developing solution having the following composition:

| | |
|---|---|
| N—Methyl-p-aminophenol (hemisulfate) | 2.5 g |
| Ascorbic acid | 10 g |
| Sodium metaborate tetrahydrate | 35 g |
| Potassium bromide | 1 g |
| Sodium thiosulfate | 3 g |
| Water to make | 1 liter |

The hydrogen peroxide (aqueous) which can be used in the present invention may be in the form of its adduct or precursor including $NaBO_2.H_2O_2.3H_2O$, $2NaCO_3.3H_2O_2$, $Na_4P_2O_7.2H_2O_2$, $2Na_2SO_4.H_2O_2.2H_2O$, etc.

The peroxy acid salts which can be used in the present invention include $K_2S_2O_8$, $K_2C_2O_6$, $K_4P_2O_8$, $K_2[Ti(O_2)C_2O_4].3H_2O$, $4.K_2SO_4.Ti(O_2)OH.SO_4.2H_2O$, $Na_3[VO(O_2)(C_2O_4)_2].6H_2O$, peracetic acid, etc.

Of the oxidizing agents that can be employed in the present invention, hydrogen peroxide or adducts or precursors thereof are particularly preferred.

These oxidizing agents can easily be synthesized, and most of them are commercially available.

The amount of the oxidizing agent to be used varies depending on the time and conditions of addition, but it generally ranges from $10^{-6}$ to 10 mols, preferably from $10^{-4}$ to 1 mol, and more preferably from $10^{-3}$ to 1 mol, per mol of silver halide.

Addition of the oxidizing agent can be effected at any stage prior to the end of the chemical ripening step, namely at any stage of the precipitation, physical ripening, washing, and chemical ripening steps. Preferred stages for addition are the precipitation, physical ripening, and chemical ripening steps.

The oxidizing agent may be added in the presence of a catalyst, such as a metal salt, e.g., a tungstate (e.g., sodium tungstate, tungsten trioxide, etc.), a vanadate (e.g., pervanadic acid, vanadium pentoxide, etc.), an osmate (e.g., osmium tetroxide, etc.), a molybdate, a manganate, an iron salt, a copper salt, etc.; selenium dioxide; an enzyme, e.g., catalase; and the like. The catalyst may either be added to a system before addition of the oxidizing agent, or may be added simultaneously with or after the addition of the oxidizing agent. The catalyst is usually used in an amount of from about 10 mmg to 1 g per mole of silver.

In the present invention, the oxidizing agent may also be used in the presence of an inorganic or organic salt other than silver salts and halogen salts. Examples of such a salt are inorganic salts, e.g., nitrates (e.g., potassium nitrate, ammonium nitrate, etc.), sulfates (e.g., potassium sulfate, sodium sulfate, etc.), phosphates, etc.; and organic salts, e.g., potassium acetate, sodium acetate, potassium citrate, etc. These salts can be added in advance to a silver salt aqueous solution or a halogen salt aqueous solution. The amount of such other salts to be used is usually from 1 to 20 g per mole of silver.

Stabilizers for hydrogen peroxide that can be used in the present invention as an oxidizing agent include phosphoric acid, barbituric acid, uric acid, acetanilide, hydroxyquinoline, sodium pyrophosphate, sodium stannate, and the like.

The oxidizing agent is used in the form of a solution in water or a water-soluble organic solvent, such as alcohols, ethers, glycols, ketones, esters, amides, and the like.

In the cases where the oxidizing agent in accordance with the present invention is used in a large quantity, a reducing material, such as sulfites, sulfinates, reducing sugars, etc., may be added to the system to thereby inactivate the excess of the oxidizing agent so as to exclude any adverse effects on the progress of chemical ripening or photographic properties of the resulting light-sensitive materials during preservation. Addition of such a reducing material may be effected at any appropriate stage, and preferably after the addition of the oxidizing agent.

The amount of the reducing material to be used is suitably selected depending on the type of the oxidizing agent used and/or the desired degree of inactivation of the remaining oxidizing agent, and is usually at least equimolar with respect to the oxidizing agent, while preferably being from 1 to 50 moles per mole of the oxidizing agent.

Silver halides which can be used in photographic emulsions according to the present invention are conventional and include silver bromide, silver iodobromide, silver iodochlorobromide, silver chlorobromide, silver iodide and silver chloride.

Grain size distribution of the silver halide emulsions may be either narrow or broad.

Silver halide grains in the photographic emulsion may have a regular crystal form, such as cubic, octahedral, tetradecahedral, rhombic, dodecahedral, etc., an irregular crystal form, such as a sphere, a plate, etc., or a composite form thereof. The silver halide grains may be a mixture of grains having various crystal forms.

Also, plate-like (tabular) silver halide grains having a diameter/thickness ratio of 3 or more (having an aspect ratio of 3 or more) can be used. Of these types of silver halide grains, the use of the above-described oxidizing agents to the plate-like silver halide grains having an aspect ratio of 3 or more is particularly effective.

The individual silver halide grains may comprise a core and an outer shell different in silver halide composition or may comprise a homogeneous phase.

The silver halide grains may be those in which silver halide crystals, e.g., silver chloride, and oxide crystals, e.g., PbO, are fused together; epitaxially grown silver halide crystals, e.g., silver bromide crystals onto which silver chloride, silver iodobromide, silver iodide or the like are epitaxially grown; and those in which regular hexahedra of silver chloride are orientatedly overgrown on hexagonal or regular octaderal silver iodide.

Silver halide emulsions may have any grain size distribution and may be mono-dispersed emulsions. The mono-dispersed silver halide emulsion herein referred to denotes a dispersion system wherein 95% of the number of total silver halide grains is included in the size range within ±60%, and preferably within ±40%, of the number average grain size. The term "number average grain size" as herein used means a number average diameter of the projected area of the total silver halide grains.

The photographic emulsions according to the present invention can be prepared by the methods described, e.g., in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc. In some detail, the photographic emulsions can be prepared by any of the acid process, the neutral process, the ammonia process, and the like. The reaction between a soluble silver salt and a soluble halogen salt can be carried out by any of a single jet method, a double jet method, or a combination thereof.

In addition, a method in which silver halide grains are produced in the presence of excess silver ions (the so-called reverse mixing method) can also be employed. Further, the so-called controlled double jet method, in which the pAg of the liquid phase wherein silver halide grains are to be precipitated is maintained constant, may be employed. According to this method, silver halide emulsions in which grains have a regular crystal form and an almost uniform size distribution can be obtained.

Two or more silver halide emulsions prepared separately may be empoyed in the form of a mixture.

The tabular silver halide grains that can be used in this invention will hereinafter be described.

The tabular silver halide grains used in the present invention have a diameter to thickness ratio of at least 3, preferably from 5 to 50, and more preferably from 5 to 20.

The term "diameter" as herein used means a diameter of a circle having the same surface area as that of the projected surface area of a grain at issue. The tabular silver halide grains according to the present invention is from 0.3 to 0.5 μm, and preferably from 0.5 to 3.0 μm.

The thickness of the tabular silver halide grains of the present invention is not more than 0.4 μm, preferably not more than 0.3 μm, and most preferably not more than 0.2 μm.

In general, tabular silver halide grains have a plate form having two parallel planes. Therefore, the term "thickness" as herein used denotes a distance between the two parallel planes constituting the tabular silver halide grain.

A preferred halogen composition of the tabular silver halide grains includes silver bromide and silver iodobromide, with silver iodobromide containing up to 30 mol% of silver iodide being particularly preferred.

These tabular silver halide grains can be prepared by an appropriate combination of processes known in the art.

For example, tabular silver halide emulsions are disclosed in Cagnac and Chatean, *Evolution of the Morphology of Silver Bromide Crystals During Physical Ripening,* Science et Industrie Photography, Vol. 33, No.(1962), pp 121–125; Duffin, *Photographic Emulsion Chemistry,* Focal Press, New York, 1966, pp 66–72; A. P. H. Trivelli and W. F. Smith, *Photographic Journal,* Vol. 80, p 285 (1940), etc., and can be easily prepared by referring to the methods disclosed in U.S. Pat. Nos. 4,434,226, 4,439,520, 4,425,426, EPC Pat. No. 84,637A2, Research Disclosure Vol. 225, Item 22534 (January, 1983), etc.

For example, by a process comprising forming seed crystals comprising 40% by weight or more of tabular grains in an atmosphere having a relatively low pBr value of 1.3 or smaller and allowing the formed seed crystals to grow while adding a silver salt solution and a halide solution simultaneously, with the pBr value being maintained constant at that level. It is desirable to add the silver salt and halide solutions while taking care not to generate new crystal nuclei.

The desired size of the tabular silver halide grains can be attained by controlling the temperature, type and amount of the solvent, rates of adding the silver salt and halide during the growth of grains, and the like.

The grain size, shape of grains including a diameter/-thickness ratio, grain size distribution, and rate of growth of grains can be controlled by using the silver halide solvent in the preparation of the tabular silver halide grains.

For example, an increase in an amount of the silver halide solvent makes grain size distribution narrow and increases the rate of growth of grains. To the contrary, there is a tendency for the grain thickness to increase as the amount of the solvent increases.

In the preparation of the tabular silver halide grains according to the present invention, methods of increasing the rates of addition, amounts and concentrations of a silver salt solution (e.g., an $AgNO_3$ aqueous solution) and a halide solution to be added are employed in order to accelerate growth of grains.

For the details of these methods, reference can be made to, e.g., British Pat. No. 1.335,925, U.S. Pat. Nos. 3,672,900, 3,650,757, and 4,242,445 and Japanese Patent Applications (OPI) Nos. 142329/80, 158124/80, 113927/83, 113928/83, 111934/83 and 111936/83, etc.

The tabular silver halide grains of the present invention can be subjected to chemical sensitization, if desired.

A layer in which the tabular silver halide grains according to the present invention are incorporated preferably contains at least 40% by weight, and more preferably at least 60% by weight, of the tabular silver halide grains based on the total silver halide grains present in the layer.

In a step of formation of silver halide grains or a step of physical ripening, a cadmium salt, a zinc salt, a lead salt, a thallium salt, an iridium salt or a complex thereof, a rhodium salt or a complex thereof, an iron salt or a complex thereof, or the like may be present. These compounds may be used in various amounts, depending on the intended type of the light-sensitive materials.

Further, if desired, a known silver halide solvent can be used. Such a silver halide solvent includes, for example, ammonia, potassium thiocyanate, and thioether or thione compounds as described in U.S. Pat. No. 3,271,157, Japanese Patent Application (OPI) Nos. 12360/76, 82408/78, 144319/78, 100717/79 and 155828/79, etc. Of these, ammonia is preferred.

Removal of soluble salts from the silver halide emulsion after the formation of silver halide grains or after the physical ripening can be effected by the known noodle washing method comprising gelling the gelatin or a flocculation method using an inorganic salt, an anionic surface active agent, an anionic polymer (e.g., polystyrene-sulfonic acid) or a gelatin derivative (e.g., acylated gelatin or carbamoylated gelatin).

The silver halide emulsions may or may not be chemically sensitized. Chemical sensitization can be carried out according to known methods as described, e.g., in H. Frieser (ed.), *Die Gründlagen der Photographischen Prozesse mit Silverhalogeniden,* 675–734, Akademische Verlagsgesellschaft (1968). More specifically, chemical sensitization can be effected by sulfur sensitization using compounds containing sulfur capable of reacting with active gelatin or silver (e.g., thiosulfates, thioureas, mercapto compounds, rhodanines, etc.), reduction sensitization using reducing materials (e.g., stannous salts, amines, hydrazine derivatives, formamidinesulfinic acid, silane compounds, etc.), noble metal sensitization using noble metal compounds (e.g., gold complexes and complexes of Periodic Table Group VIII metals, e.g., Pt, Ir, Pd, etc.) or a combination thereof.

Further, in the sensitization using the gold complexes, it is preferred to use a ligand of gold as an auxiliary agent, such as a thiosulfate, potassium thiocyanate, a thioether, etc. A particularly preferred auxiliary agent is potassium thiocyanate.

Specific examples of chemical sensitization are described, e.g., in U.S. Pat. Nos. 1,574,944, 2,410,689, 2,278,947, 2,728,668, and 3,656,955 for sulfur sensitization; in U.S. Pat. Nos. 2,983,609, 2,419,974, and 4,054,458 for reduction sensitization; and in U.S. Pat. Nos. 2,399,083 and 2,448,060 and British Pat. No. 618,061 for noble metal sensitization.

Of these sensitization methods, a combination of sulfur sensitization and gold complex sensitization is preferably used.

The amount of the sensitizer varies depending upon the type of silver halide emulsion, but generally, a sulfur sensitizer can be used in an amount of from $1\times10^{-7}$ to $1\times10^{-4}$ mole per mole of silver, and a noble metal sensitizer can be used in an amount of from $1\times10^{-7}$ to $1\times10^{-4}$ mole per mole of silver. The auxiliary agent for the gold complex sensitizer is preferably used in an amount of from $1\times10^{-5}$ to $1\times10^{-2}$ mole per mole of silver.

Photographic emulsions according to the present invention can contain various compounds for the purpose of preventing fog during preservation or photographic processing or stabilizing photographic properties. Examples of such compounds are azoles, such as benzothiazolium salts, nitroindazoles, triazoles, benzotriazoles and benzimidazoles (especially, nitro- or halogen-substituted benzimidazoles); heterocyclic mercapto compounds such as mercaptothiazoles, mercaptobenzothiazoles, mercaptobenzimidazoles, mercaptothiadiazoles, mercaptotetrazoles (especially, 1-phenyl-5-mercaptotetrazole) and mercaptopyrimidines; the above-described heterocyclic mercapto compounds having water-soluble groups, e.g., a carboxyl group, s sulfo group, etc.; thioketo compounds, such as oxazolinethione, azaindenes, such as tetraazaindenes (especially, 4-hydroxy-substituted (1,3,3a,7)-tetraazaindenes); benzenethiosulfonic acids; benzene-sulfinic acids; and other various compounds known as anti-foggants or stabilizers. Detailed descriptions of such compounds and usages thereof are set forth, e.g., in E. J. Birr, *Stabilization of Photographic Silver Halide Emulsions,* Focal Press (1974).

The photographic emulsions used in the light-sensitive materials of this invention can be spectrally sensitized to blue light of relatively long wavelength, green light, red light or infrared light using sensitizing dyes. Sensitizing dyes which can be used for spectral sensitization include cyanine dyes, merocyanine dyes, complex cyanine dyes, complex merocyanine dyes, holopolar cyanine dyes, styryl dyes, hemicyanine dyes, oxonol dyes, hemioxonol dyes, and the like. Specific examples of the sensitizing dyes are described, e.g., in P. Glafkides, *Chimie Photographique,* 2nd Edition, Chapters 35–41, Paul Montel (1957); F. M. Hamer, *The Cyanine and Related Compounds,* Interscience, U.S. Pat. Nos. 2,503,776, 3,459,553, and 3,177,210, *Research Disclosure,* Vol. 176, RD No. 17643, Sec. 23, IV, Item J (December, 1978), etc.

Examples of preferred sensitizing dyes include cyanine dyes, merocyanine dyes and complex cyanine dyes. The sensitizing dye can be used in any step of the process for producing the silver halide emulsion, but is preferably used after addition of the above-described oxidizing agent.

Hydrophilic colloidal layers of the light-sensitive materials prepared according to the present invention may contain water-soluble dyes as filter dyes or for various purposes, such as prevention of irradiation. Such dyes include oxonol dyes, hemioxonol dyes, styryl dyes, merocyanine dyes, cyanine dyes and azo dyes, with oxonol dyes, hemioxonol dyes and merocyanine dyes being particularly useful.

The photographic emulsion layers or other hydrophilic colloidal layers of the photographic light-sensitive materials according to the present invention may further contain inorganic or organic hardeners. The hardeners which can be used include chromium salts, e.g., chromium alum, chromium acetate, etc.; aldehydes, e.g., formaldehyde, glyoxal, glutaraldehyde, etc.); N-methylol compounds, e.g., dimethylurea, methyloldimethylhydantoin, etc.; dioxane derivatives, e.g., 2,3-dihydroxydioxane, etc.; active vinyl compounds, e.g., 1,3,5-triacryloyl-hexahydro-s-triazine, 1,3-vinylsulfonyl-2-propanol, etc.; active halogen compounds, e.g., 2,4-dichloro-6-hydroxy-s-triazine, etc.; mucohalogenic acids, e.g., mucochloric acid, mucophenoxychloric acid, etc.; and combinations thereof.

The photographic emulsion layers or other hydrophilic colloidal layers of the light-sensitive materials according to the present invention may furthermore contain a wide variety of surface active agents for various purposes, for example, as a coating aid or an antistatic agent, or for improvement of the slipping property, dispersibility or photographic properties (e.g., acceleration of development, increase of contrast, and sensitization) or for prevention of adhesion.

Examples of the surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or alkyl aryl ethers, polyethylene glycol esters, polyethylene glycol sorbitan esters, polyalkylene glycol alkylamines or amides, polyethylene oxide adducts of silicon, etc.), glycidol derivatives (e.g., alkenylsuccinic acid polyglycerides, alkylphenol polyglycerides, etc.), fatty acid esters of polyhydric alcohols, alkyl esters of sugars, and the like; anionic surface active agents containing acidic groups, e.g., carboxyl, sulfo, phospho, sulfate, phosphate and like groups, such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

The photographic emulsions of the present invention may contain, for example, polyalkylene oxides and derivatives thereof, such as ethers, esters and amines, thioether compounds, thiomorpholines, quaternary ammonium salt compounds, urethane derivatives, urea derivatives, imidazole derivatives, 3-pyrazolidones and the like in order to increase sensitivity or contrast or accelerate development.

Binders or protective colloids which can be used in the photographic emulsion layers or intermediate layers of the light-sensitive materials according to the present invention advantageously include gelatins, but other hydrophilic colloids may also be used.

Examples of suitable hydrophilic colloids include proteins, such as gelatin derivatives, graft polymers obtained by grafting other high polymers onto gelatin, albumin, casein, etc.; cellulose derivatives, such as hydroxyethyl cellulose, carboxymethyl cellulose, cellulose sulfates, etc.; sugar derivatives, such as sodium alginate, starch derivatives, etc.; and a wide variety of synthetic hydrophilic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers containing repeating units which constitute the above-described polymers.

The photographic light-sensitive materials of the present invention can contain, in the photographic emulsion layers thereof, color forming couplers, i.e., compounds capable of forming colors by oxidative coupling with aromatic primary amine developers (e.g., phenylenediamine derivatives, aminophenol derivatives, etc.) in color development processing. Examples of conventional magenta couplers which can be used include 5-pyrazolone couplers, pyrazolobenzimidazole couplers, cyanoacetylcumarone couplers open-chain acylacetonitrile couplers, and the like. Examples of conventional yellow couplers which can be used include acylacetamide couplers (e.g., benzoyl acetanilides, pivaloyl acetanilides, etc.), and the like. Examples of conventional cyan couplers which can be used include naphthol couplers and phenol couplers. These couplers preferably have hydrophobic groups called ballast groups in their molecules and are thereby rendered non-diffusible. These couplers may be either four-equivalent or two-equivalent to silver ions. Moreover, they may be colored couplers having a color correcting effect, or the so-called DIR couplers capable of releasing development restrainers.

In addition to the DIR couplers, the photographic emulsion layers may contain colorless DIR coupling compounds which yield colorless products upon coupling and release development restrainers.

The light-sensitive materials prepared in accordance with the present invention may contain hydroquinone derivatives, aminophenol derivatives, gallic acid derivatives, ascorbic acid derivatives, and the like as color fog preventing agents.

The light-sensitive materials prepared in accordance with the present invention may contain ultraviolet absorbents in their hydrophilic colloidal layers. Examples of usable ultraviolet absorbents are benzotriazole compounds substituted with an aryl group as described, e.g., in U.S. Pat. No. 3,533,794; 4-thiazolidone compounds as described, e.g., in U.S. Pat. Nos. 3,314,794 and 3,352,681; benzophenone compounds as described, e.g., in Japanese Patent Application (OPI) No. 2784/71; cinnamic acid ester compounds as described, e.g., in U.S. Pat. Nos. 3,705,805 and 3,707,375; butadiene compounds as described, e.g., in U.S. Pat. No. 4,045,229; and benzoxazole compounds as described, e.g., in U.S. Pat. No. 3,700,455. In addition, those described in U.S. Pat. No. 3,499,762 and Japanese Patent Application (OPI) No. 48535/79 can also be employed. Ultraviolet absorbing couplers, such as α-naphthol cyan dye forming couplers, or ultraviolet absorbing polymers may also be employed. These ultraviolet absorbents may be fixed to a specific layer by a mordant.

In carrying out the present invention, known discoloration inhibitors may be used. Dye image stabilizers which can be used in the present invention may be used alone or in combinations of two or more. Known discoloration inhibitors include hydroquinone derivatives, gallic acid derivatives, p-alkoxyphenols, p-oxyphenol derivatives, bisphenols, and the like.

The silver halide photographic emulsions in accordance with the present invention may further contain various other additives, such as fluorescent brightening agents, desensitizers, plasticizers, slipping agents, matting agents, oils, mordants, and the like.

Specific examples of such additives are set forth in *Research Disclosure,* No. 176, RD-17643, pp 22–31, (December 1978), etc.

The emulsions according to the present invention can be used in various color and black-and-white silver halide light-sensitive materials. For example, they are applicable to color positive films, color papers, color negative films, color reversal films containing or not containing couplers, photographic light-sensitive materials for plate making (e.g., lith films), light-sensitive materials for CRT (cathode ray tube) display, light-sensitive materials for X-ray recording (especially, screen type direct or indirect X-ray films), light-sensitive materials for colloid transfer process, silver salt diffusion transfer process, dye transfer process or silver dye bleach process, printing-out papers, heat-developable light-sensitive materials, and the like.

Exposure for obtaining a photographic image can be conducted in a conventional manner using various known light sources, such as natural light (sunlight), a tungsten lamp, a fluorescent lamp, a mercury lamp, a xenon arc lamp, a carbon arc lamp, a CRT flying spot, a light emitting diode, a laser beam (e.g., gas laser, YAG (yttrium-aluminum-garnet) laser, dye laser, semiconductor laser, etc.). Exposure may also be effected using light emitted from fluorescent substances excited by electron beams, X-rays, γ-rays, α-rays, etc.

Suitable exposure times include not only the exposure times commonly used in cameras ranging from about 1/1,000 to about 1 sec., but also exposure times shorter than 1/1,000 sec., for example, about $1/10^4$ to about $1/10^6$ sec. as with xenon flash lamps and cathode ray tubes. Exposure times longer than 1 second can also be used. The spectral composition of the light employed for the exposure can be controlled using color filteres, if desired.

Any conventional methods and processing solutions as described, e.g., in *Research Disclosure,* No. 176, 28–30 (RD-17643), can be applied to photographic processing of photographic emulsions according to the present invention. Any photographic processing, whether for the formation of silver images (black-and-white photographic processing) or for the formation of dye images (color photographic processing), can be used depending on the end use of the light-sensitive materials. Processing temperatures are generally selected from the range of from 18° to 50° C., but temperatures lower than 18° C. or higher than 50° C. may also be used.

The present invention will now be illustrated in greater detail with reference to examples, but it should be understood that the present invention is not limited thereto. In these examples, all percents are by weight unless otherwise indicated.

EXAMPLE 1

Aqueous ammonia was added to a gelatin aqueous solution containing potassium bromide, potassium iodide, and ammonium nitrate, which was maintained at 75° with vigorous stirring. A silver nitrate aqueous solution and a potassium bromide aqueous solution were simultaneously added to the mixture over a period of 60 minutes. The resulting silver halide emulsion was found to predominantly contain twin crystals of silver halide with a minor proportion of normal crystals.

After 61 minutes from the preparation, the emulsion was adjusted to a pH as shown in Table 1 with sulfuric acid. After 62, 63 or 85 minutes from the preparation (i.e., after 1, 2 or 24 minutes from the pH-adjustment), a compound was added to the emulsion with the kind and amount per mole of silver being shown in Table 1. Then, the temperature was lowered after 90 minutes from the preparation, and each of the emulsions was washed in accordance with a known flocculation method.

The resulting emulsion was adjusted to a pH of 6.5 and a pAg of 8.9, and then subjected to gold-sulfur sensitization using sodium thiosulfate, potassium chloroaurate and potassium thiocyanate at 63° C. for an optimum time period so that all the emulsion may have equal sensitivity. Each of Emulsions 1 through 6 thus prepared was a silver iodobromide emulsion having a mean grain size of about 0.9 μm and an iodide content of 8 mol%.

To each of the emulsions were successively added a magenta coupler emulsion comprising 1-(2,4,6-trichlorophenyl)-3-[3-(2,4-di-t-amylphenoxyacetamido)-benzamide]-5-pyrazolone and tricresyl phosphate; 4-hydroxy-6-methyl-1,3,3a,7-tetraazaindene as a stabilizer; 1,3-bis-vinylsulfonylhydroxypropane as a hardener; and sodium p-dodecylbenzenesulfonate and sodium p-nonylphenoxypoly(ethyleneoxy)propanesulfonate as coating aids.

The resulting emulsion was coated on a cellulose acetate film support, followed by drying to obtain Samples 1 to 7.

Each of the samples was exposed to light through an optical wedge and subjected to the following color development processing. The fog immediately after the coating was determined, and the results are shown in Table 1.

The development processing employed in this example was carried out at 38° C. as follows.

| | |
|---|---|
| 1. Color Development | 2'45" |
| 2. Bleaching | 6'30" |
| 3. Washing | 3'15" |
| 4. Fixing | 6'30" |
| 5. Washing | 3'15" |
| 6. Stabilization | 3'15" |

The processing solution used in each processing step had the following composition:

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |
| Bleaching Solution: | |
| Ammonium bromide | 160.0 g |
| Aqueous ammonia (28%) | 25.0 ml |
| Sodium (ethylenediaminetetra-acetato) Iron | 130.0 g |
| Glacial acetic acid | 14.0 ml |
| Water to make | 1 liter |
| Fixing Solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing Solution: | |
| Formalin | 8.0 ml |
| Water to make | 1 liter |

TABLE 1

| Sample No. | pH-Adjustment | Compound Added (Amount/mol-Ag) 62nd Min. | 63rd Min. | 85th Min. | Immediately After Coating Fog | Relative Sensitivity | Fog with Time Fog | Relative Sensitivity | Preservability of Latent Image Relative Sensitivity |
|---|---|---|---|---|---|---|---|---|---|
| 1 | pH 6 | — | — | — | 0.21 | 100 | 0.48 | 125 | 105 |
| 2 | pH 3 | — | — | — | 0.18 | 100 | 0.35 | 110 | 98 |
| 3 (Invention) | pH 6 | $H_2O_2$ (35%) (10 ml) | — | — | 0.08 | 100 | 0.12 | 105 | 95 |
| 4 (Invention) | pH 6 | $H_2O_2$ (35%) (10 ml) | sodium tungstate (200 mg) | — | 0.06 | 100 | 0.09 | 100 | 90 |
| 5 (Invention) | pH 6 | $H_2O_2$ (35%) (10 ml) | — | sodium benzene-sulfinate (12 g) | 0.08 | 100 | 0.13 | 110 | 105 |
| 6 (Invention) | pH 6 | $K_2S_2O_8$ (13.5 g) | — | — | 0.11 | 100 | 0.14 | 95 | 95 |
| 7 (Comparison) | pH 6 | potassium ferricyanide (170 mg) | — | — | 0.06 | 100 | 0.09 | 90 | 60 |

Further, the fog and relative sensitivity of the unexposed sample when preserved at 50° C. and 20% RH for 5 days (test for fog with time) and the relative sensitivity of exposed sample when preserved at 45° C. and 75% RH for 14 days and then development-processed (test of preservability of the latent image) were determined, and the results are also shown in Table 1. In Table 1, the relative sensitivity was expressed in terms of a relative value of a reciprocal of an exposure required for providing a density of fog +0.2, taking the sensitivity of Sample 1 immediately after the coating as 100.

As is apparent from Table 1, use of the oxidizing agent according to the present invention satisfactorily restrains fog, improves preservability of unexposed light-sensitive material, preservability of the latent image, as compared with potassium ferricyanide.

EXAMPLE 2

Ammonia was added to a gelatin aqueous solution kept at 75° C. while vigorously stirring. A silver nitrate aqueous solution and a mixed aqueous solution of potassium bromide and potassium iodide were simultaneously added thereto while maintaining the mixture at a pAg of 8.6, thereby to prepare a mono-dispersed octahedral silver iodobromide emulsion having a mean grain size of about 0.65 μm and an iodide content of 30 mol%. The emulsion was washed with water in a conventional manner and then adjusted to a pH of 6.0 and a pAg of 8.6 to obtain a seed emulsion.

In 1,000 ml of water was dissolved 250 g of the seed emulsion, which amount corresponded to 50 g of silver nitrate, and the solution was heated to 75° C.

An oxidizing agent shown in Table 1 was added to the solution. After stirring for 20 minutes, 800 ml of a silver nitrate aqueous solution containing 100 g of silver nitrate and 850 ml of a potassium bromide aqueous solution containing 85 g of potassium bromide were simultaneously added thereto while maintaining a pAg of 8.3, so as to avoid re-nucleation, to obtain a mono-dispersed octahedral silver iodobromide emulsion having a mean grain size of about 0.94 μm and an iodide content of 10 mol%. After washing in a conventional manner, each of the emulsions was adjusted to a pH of 6.5 and a pAg of 8.9 and then subjected to gold-sulfur sensitization with sodium thiosulfate, potassium chloroaurate and potasssium thiocyanate for an optinum time period so that all the emulsion samples may have equal sensitivity.

To the resulting emulsion were successively added 5,5'-dichloro-9-ethyl-3,3'-di-(3-sulfopropyl)oxacarbocyanine sodium salt as a sensitizing dye and the same additives as used in Example 1 (i.e., magenta coupler, stabilizer, hardener and coating aids). The resulting emulsion was coated on a cellulose acetate film support and dried to prepare Samples 8 to 10.

Each of the samples thus prepared was exposed to light through a yellow filter and an optical wedge, and photographic properties were determined in the same manner as in Example 1. The results are shown in Table 2.

TABLE 2

| Sample No. | Compound Added (Amount) | Fog | Relative Sensitivity |
|---|---|---|---|
| 8 | — | 0.20 | 100 |
| 9 | $H_2O_2$ (35%) (4.5 ml) | 0.09 | 100 |
| 10 | $H_2O_2$ (35%) (4.5 ml) + $Na_2WO_4 \cdot 2H_2O$ (200 mg) | 0.06 | 100 |

It can be seen from Table 2 that fog can be remarkably inhibited by the use of hydrogen peroxide in accordance with the present invention.

EXAMPLE 3

In order to evaluate fog in the interior of crystal grains of the samples as prepared in Example 2, each sample was immersed in a bleaching solution comprising 0.3% potassium ferricyanide containing phenosafranine at 20° C. for 10 minutes. After washing with running water for 10 minutes, the sample was subjected to internal development using the developing solution as described for the internal development (B) at 20° C. for 10 minutes, followed by fixing, washing and drying. The results of fog are shown in Table 3.

TABLE 3

| Sample No. | Fog |
|---|---|
| 8 | 0.22 |
| 9 | 0.07 |
| 10 | 0.04 |

As is apparent from the results of Table 3, use of hydrogen peroxide restrains fog not only on the surface of crystal grains (cf. Table 2) but also in the interior of the crystal grains.

EXAMPLE 4

Silver halide grains were formed in the same manner as described in Example 2 except for replacing ammonia by potassium thiocyanate (Samples 11 and 12) or 4,7-dithia-1,2,9,10-decanetetraol (Samples 13 and 14). The resulting emulsion was thoroughly washed 4 times with a weakly acidic washing solution containing 3 g/L of potassium bromide to remove the silver halide solvent used thereby prepare a seed emulsion having a mean grain size of 0.65 μm. After the oxidizing agent according to the present invention was added in the same manner as in Example 2, a silver nitrate aqueous solution and a potassium bromide aqueous solution were simultaneously added thereto to form silver halide grains having a mean grain size of 0.94 μm. The resulting emulsion was subjected to gold-sulfur sensitization in the same manner as in Example 2 so that all the emulsions may have the equal sensitivity.

To the thus prepared emulsion, the same additives as used in Example 2 were added (i.e., sensitizing dye, magenta coupler, stabilizer, hardener and coating aids), and the emulsion was treated and tested in the same manner as in Example 2. The results obtained are shown in Table 4.

TABLE 4

| Sample No. | Silver Halide Solvent | Oxidizing Agent (Amount) | Photographic Property: Fog | Photographic Property: Relative Sensitivity |
|---|---|---|---|---|
| 11 | potassium thiocyanate | — | 0.15 | 100 |
| 12 | potassium thiocyanate (8 ml) | $H_2O_2$ (35%) | 0.08 | 100 |
| 13 | 4,7-dithia-1,2,9,10-decanetetraol | — | 0.13 | 100 |
| 14 | 4,7-dithia-1,2,9,10-decanetetraol | $H_2O_2$ (35%) (8 ml) | 0.08 | 100 |

It can be seen from Table 4 that fog can be remarkably inhibited by using hydrogen peroxide according to the present invention (Samples 12 and 14).

EXAMPLE 5

A silver nitrate solution and an aqueous solution of a mixture of potassium iodide and potassium bromide were added to a gelatin aqueous solution containing potassium bromide kept at 70° C. while stirring according to a double jet method.

After the addition, soluble salts were removed by a flocculation method. Gelatin was additionally added thereto and dissolved therein, followed by adjustment to a pH of 6.8. The resulting tabular silver halide grains had a mean diameter of 1.9 μm, a thickness of 0.14 μm, an average diameter/thickness ratio of 13.6, and an iodine content of 3 mol%. The emulsion showed a pAg of 8.95 at 40° C.

The emulsion was divided in two. One of the halves was subjected to gold-sulfur sensitization using sodium thiosulfate, potassium chloroaurate, and potassium thiocyanate under the optimum conditions for the maximum sensitization when fog after the subsequent development processing was 0.01 to prepare Comparative Emulsion A.

To another half was added 3.96% hydrogen peroxide in an amount of 10 ml per mole of silver immediately before the start of gold-sulfur sensitization, and then gold-sulfur sensitization was conducted in the same manner as described above under the optimum conditions for the maximum sensitization when fog was 0.01 to prepare Emulsion B.

After completion of the chemical sensitization, each of Emulsions A and B was green-sensitized by adding 500 mg of anhydro-5,5'-dichloro-9-ethyl-3,3'-di(3-sulfopropyl)oxacarbocyanine hydroxide sodium salt and 200 mg of potassium iodide each per mole of silver.

4-Hydroxy-6-methyl-1,3,3a,7-tetraazaindene as a stabilizer, sodium p-dodecylbenzenesulfonate as a coating aid, and sodium 2,4-dichloro-6-hydroxy-s-triazine as a hardener were then added thereto, and the resulting emulsion was coated on a polyethylene terephthalate film support together with a surface protective layer by co-extrusion, followed by drying.

Each of the samples thus prepared was exposed to light through an optical wedge under a yellow filter, developed with a developer "Hi-Rendol" (made by Fuji Photo Film Co., Ltd.) at 20° C. for 4 minutes, fixed, washed, and dried.

The results obtained are shown in Table 5, in which the relative sensitivity was calculated from an exposure necessary to obtain a blackening ratio of fog+1.0.

TABLE 5

| Sample | Fog | Relative Sensitivity |
|---|---|---|
| A (Comparison) | 0.01 | 100 (standard) |
| B (Invention) | 0.01 | 195 |

It can be seen from the results of Table 5 that the relative sensitivity can be significantly improved by using hydrogen peroxide as an oxidizing agent at the time of chemical ripening.

EXAMPLE 6

An aqueous solution of silver nitrate and an aqueous solution of potassium iodide and potassium bromide were added to an aqueous solution of potassium bromide and gelatin kept at 63° C. while stirring according to a double jet method.

After the addition, the mixture was cooled to a temperature of 35° C., and soluble salts were removed by a flocculation method. After elevating the temperature of the mixture to 40° C., gelatin was additionally added thereto and dissolved therein, followed by adjustment to a pH of 6.8.

The resulting tabular silver halide grains had a mean diameter of 0.90 μm, a thickness of 0.135 μm, an average diameter/thickness ratio of 6.7, and an iodine content of 3 mol%. The emulsion was divided in two (Emulsions C and D).

Emulsion C was subjected to gold-sulfur sensitization using 5-benzylidene-3-ethylrhodanine, potassium chloroaurate, and potassium thiocyanate under the optimum conditions for the maximum sensitization when fog after the subsequent development processing was 0.01.

To Emulsion D was added 5 ml of 3.96 wt% hydrogen peroxide, and then subjected to the gold-sulfur sensitization in the same manner as described above under the optimum conditions for the maximum sensitization when fog was 0.01:

After completion of the chemical sensitization, each of Emulsions C and D was green-sensitized by adding 500 mg of anhydro-5-chloro-5'-phenyl-9-ethyl-3-(3-sulfopropyl)-3'-(3-sulfoethyl)oxacarbocyanine hydroxide sodium salt and 100 mg of potassium iodide each per mole of silver.

Then, the same stabilizer, coating aid and hardner as those used in Example 5 were added to each of Emulsions C and D, and the resulting emulsion was coated on a polyethylene terephthalate film, followed by drying.

Each of the samples thus prepared was then exposed to light, developed and treated in the same manner as described in Example 5. The results obtained are shown in Table 6.

TABLE 6

| Sample | Fog | Relative Sensitivity |
|---|---|---|
| C (Comparison) | 0.01 | 100 (Standard) |
| D (Invention) | 0.01 | 210 |

It can be seen from the results of Table 6 that the relative sensitivity can be significantly improved according to the present invention.

EXAMPLE 7

The same experiment as described in Example 6 was repeated except for using an aqueous solution of potassium bromide instead of the mixed solution of KI and KBr to be mixed with the silver nitrate solution in the step of silver halide grain formation. In this experiment, triethyl thiourea was used instead of 5-benzylidene-3-ethylrhodanine as a chemical sensitizer. The resulting tabular silver halide was a pure silver bromide having an average grain size of 0.75 μm, a thickness of 0.147 μm and an average diameter/thickness ratio of 5.1. The resulting emulsion was divided into two portions to prepare Emulsion E (Comparative) and Emulsion F (Invention).

The results obtained are shown in Table 7.

TABLE 7

| Sample No. | Emulsion | Amount of Sensitizing Dye (mole per mole of silver) | Fog | Relative Sensitivity | Remarks |
|---|---|---|---|---|---|
| 7-1 | E (no $H_2O_2$) | — | 0.01 | 100 | Comparative |
| 7-2 | F ($H_2O_2$ added) | — | 0.01 | 185 | Invention |
| 7-3 | E (no $H_2O_2$) | (a) $7.5 \times 10^{-7}$ | 0.22 | 100 | Comparative |
| 7-4 | F ($H_2O_2$ added) | (a) $7.5 \times 10^{-7}$ | 0.11 | 290 | Invention |
| 7-5 | E (no $H_2O_2$) | (b) $8 \times 10^{-4}$ | 0.01 | 100 | Comparative |
| 7-6 | F ($H_2O_2$ added) | (b) $8 \times 10^{-4}$ | 0.01 | 220 | Invention |
| 7-7 | E (no $H_2O_2$) | (c) $1.8 \times 10^{-3}$ | 0.05 | 100 | Comparative |
| 7-8 | F ($H_2O_2$ | (c) $1.8 \times 10^{-3}$ | 0.02 | 265 | Invention |

TABLE 7-continued

| Sample No. | Emulsion | Amount of Sensitizing Dye (mole per mole of silver) | Fog | Relative Sensitivity | Remarks |
|---|---|---|---|---|---|
| | added) | | | | |

Sensitizing Dyes (a)

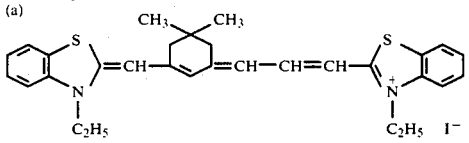

(b)

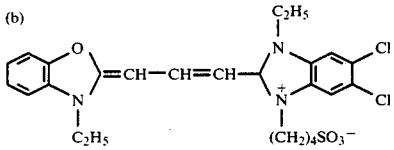

(c)

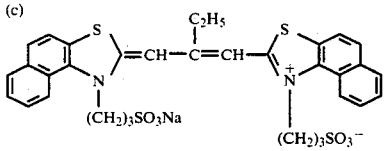

The relative sensitivity in Table 7 was calculated from the amount of exposure to white light through an optical wedge required for obtaining a degree of blackening of +1.0 fog, and is expressed in terms of a relative value to 100 in case of the emulsion where hydrogen peroxide was not added.

It is apparent from Table 7 that the present invention markedly improves the sensitivity and also inhibits the fog.

EXAMPLE 8

In this example, the same emulsions as those used in Example 6, were used. After adding a sensitizing dye shown below to the emulsion, the same stabilizer, coating aid and hardening agent as those used in Example 5 were added to the emulsion, which was then coated on a TAC film support.

The samples thus prepared were then exposed to blue light through a band pass filter having a peak of transmitting light at 410 nm, and developed with the same developer as used in Example 1, followed by fixing, washing with water and drying.

The results obtained are shown in Table 8.

TABLE 8

| Sample No. | Emulsion | Sensitizing Dye mole/mole of silver | Fog | Relative Sensitivity | Remarks |
|---|---|---|---|---|---|
| 8-1 | C (no $H_2O_2$) | — | 0.02 | 100 | Comparative |
| 8-2 | D ($H_2O_2$ added) | — | 0.01 | 110 | Invention |
| 8-3 | C (no $H_2O_2$) | (d) $8 \times 10^{-4}$ | 0.08 | 100 | Comparative |
| 8-4 | D ($H_2O_2$ added) | (d) $8 \times 10^{-4}$ | 0.07 | 152 | Invention |
| 8-5 | C (no $H_2O_2$) | (e) $8 \times 10^{-4}$ | 0.10 | 100 | Comparative |
| 8-6 | D ($H_2O_2$ added) | (e) $8 \times 10^{-4}$ | 0.08 | 131 | Invention |
| 8-7 | C (no $H_2O_2$) | (f) $8 \times 10^{-4}$ | 0.01 | 100 | Comparative |
| 8-8 | D ($H_2O_2$ added) | (f) $8 \times 10^{-4}$ | 0.01 | 164 | Invention |
| 8-9 | C (no $H_2O_2$) | (g) $8 \times 10^{-4}$ | 0.02 | 100 | Comparative |
| 8-10 | D ($H_2O_2$ added) | (g) $8 \times 10^{-4}$ | 0.02 | 220 | Invention |
| 8-11 | C (no $H_2O_2$) | (h) $8 \times 10^{-4}$ | 0.20 | 100 | Comparative |
| 8-12 | D ($H_2O_2$ added) | (h) $8 \times 10^{-4}$ | 0.22 | 277 | Invention |

Sensitizing Dye (d)

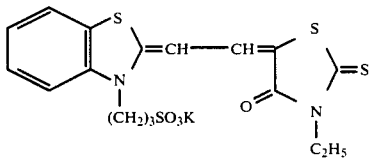

(e)

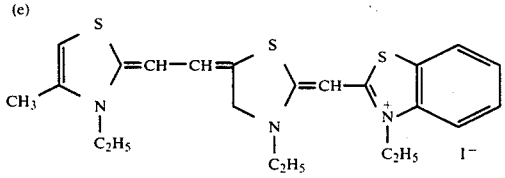

(f)

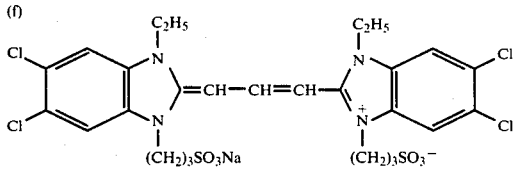

(g)

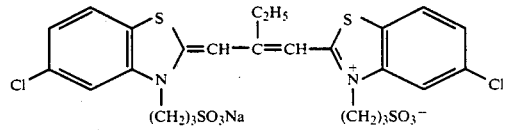

(h)

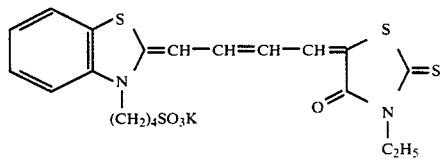

The relative sensitivity in Table 8 is expressed in terms of a relative value to 100 in case of the emulsion where hydrogen peroxide was not added. As is apparent from Table 8, the emulsion according to the present invention exhibits excellent effects, particularly in increasing the inherent sensitivity when the sensitizing dye is added to the emulsion.

EXAMPLE 9

A multilayer color photographic light-sensitive material, Sample 101, comprising a cellulose triacetate film support with the layers as described below provided thereon was produced.

SAMPLE 101

1st Layer: Antihalation Layer (AHL)

Gelatin layer containing black colloid silver

2nd Layer: Intermediate Layer (ML)

Gelatin layer containing an emulsified dispersion of 2,5-di-tert-octylhydroquinone 3rd Layer: First Red-Sensitive Emulsion Layer ($RL_1$)

Silver Iodobromide Emulsion A-1 (silver iodide: 5 mole%; mean grain diameter: 0.70μ; thickness: 0.10μ; aspect ratio: 7.0; amount of silver coated: 1.8 g/m²)

Sensitizing Dye I, $6\times10^{-4}$ mole per mole of silver

Sensitizing Dye II, $1.5\times10^{-5}$ mole per mole of silver

Coupler (EX-1), 0.04 mole per mole of silver

Coupler (Ex-5), 0.003 mole per mole of silver

Coupler (D-3), 0.0006 mole per mole of silver

4th Layer: Second Red-Sensitive Emulsion Layer ($RL_2$)

Silver Iodobromide Emulsion B-2 (silver iodide: 7 mole%; mean grain diameter: 1.0μ; thickness: 0.15μ; aspect ratio: 6.7; amount of silver coated: 1.4 g/m²)

Sensitizing Dye I, $3\times10^{-4}$ mole per mole of silver

Sensitizing Dye II, $1.2\times10^{-5}$ mole per mole of silver

Coupler (EX-2) 0.02 mole per mole of silver

Coupler (EX-5), 0.0016 mole per mole of silver

5th Layer: Intermediate Layer (ML)

Same as the 2nd layer.

6th Layer: First Green-Sensitive Emulsion Layer ($GL_1$)

Silver Iodobromide Emulsion C-1 (silver iodide: 4 mole%; mean grain diameter: 0.60 μm; thickness: 0.10μ; aspect ratio: 6.0; amount of silver coated: 1.5 g/m²)

Sensitizing Dye III, $3\times10^{-4}$ mole per mole of silver

Sensitizing Dye IV, $1\times10^{-4}$ mole per mole of silver

Coupler (EX-4), 0.05 mole per mole of silver

Coupler (EX-8), 0.008 mole per mole of silver

Coupler (D-3), 0.0015 mole per mole of silver

7th Layer: Second Green-Sensitive Emulsion Layer ($GL_2$)

Silver Iodobromide Emulsion D-1 (silver iodide: 6 mole%; mean grain diameter: 1.00μ; thickness: 0.15μ; aspect ratio: 6.7; amount of silver coated: 1.6 g/m²)

Sensitizing Dye III, $2.5\times10^{-4}$ mole per mole of silver

Sensitizing Dye IV, $0.8\times10^{-4}$ mole per mole of silver

Coupler (EX-3), 0.003 mole per mole of silver

Coupler (M-3), 0.017 mole per mole of silver

8th Layer: Yellow Filter Layer (YFL)

Gelatin layer containing yellow colloid silver and a 2,5-di-tert-octylhydroquinone emulsified dispersion 9th Layer: First Blue-Sensitive Emulsion Layer ($BL_1$)

Silver Iodobromide Emulsion E-1 (silver iodide: 6 mole%; mean grain diameter: 0.60μ; thickness: 0.10μ; aspect ratio: 6.0; amount of silver coated: 1.5 g/m²

Sensitizing Dye V, $2\times10^{-4}$ mole per mole of silver

Coupler (EX-9), 0.25 mole per mole of silver

Coupler (D-3), 0.015 mole per mole of silver

10th Layer: Second Blue-Sensitive Emulsion Layer ($BL_2$)

Silver Iodobromide Emulsion F-1 (silver iodide: 6 mole%; mean grain diameter: 1.20 μ; thickness: 0.20μ; aspect ratio: 6.0; amount of silver coated: 1.1 g/m²

Sensitizing Dye V, $1\times10^{-4}$ mole per mole of silver

Coupler (EX-9), 0.06 mole per mole of silver

11th Layer: Protective Layer (PL)

Gelatin layer, containing trimethyl methacrylate particles (diameter: about 1.5μ).

In each of the foregoing layers were incorporated a gelatin hardener, (H-1), and a surface active agent.

The sample produced in the manner as described above is called as "Sample 101".

The compounds used herein are as follows:

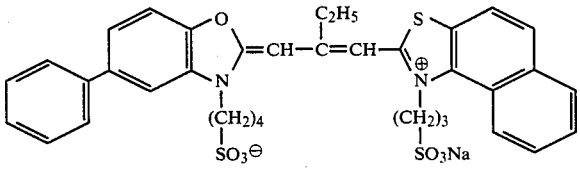

Sensitizing Dye I

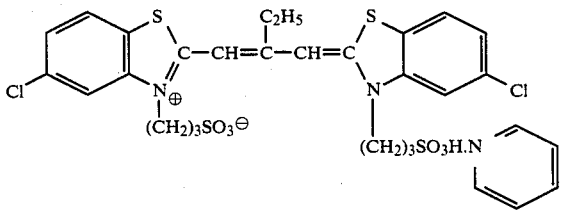

Sensitizing Dye II

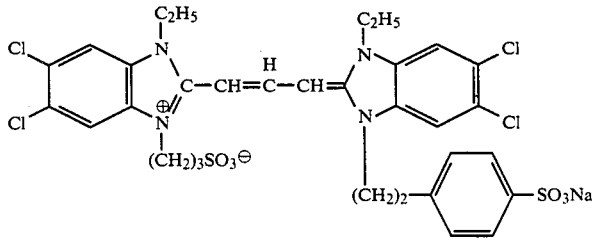

Sensitizing Dye III

-continued
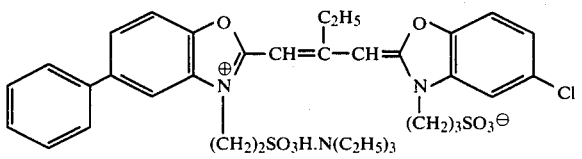
Sensitizing Dye IV
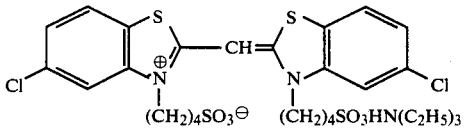
Sensitizing Dye V
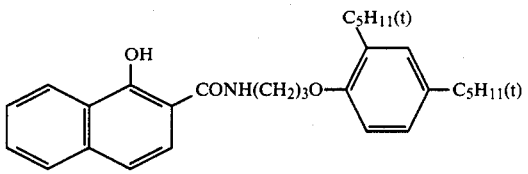
Coupler (EX-1)
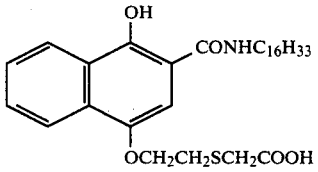
Coupler (EX-2)
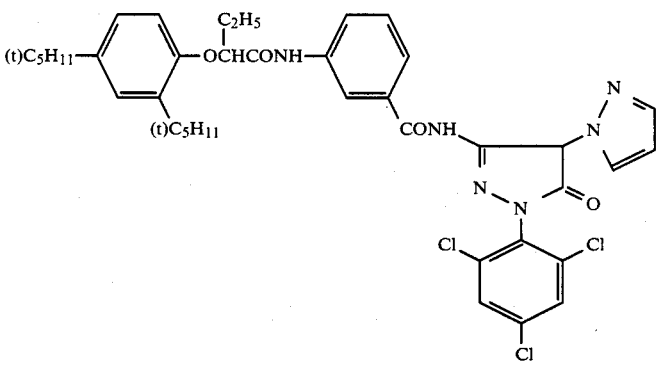
Coupler (EX-3)
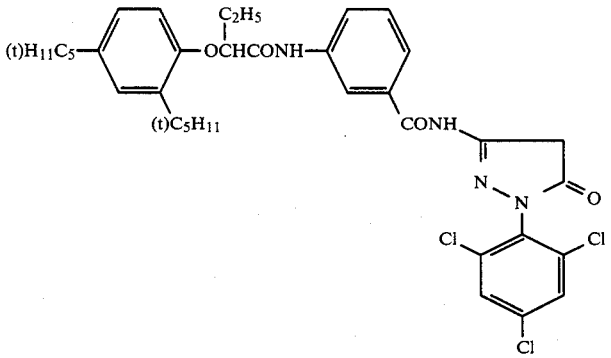
Coupler (EX-4)

-continued
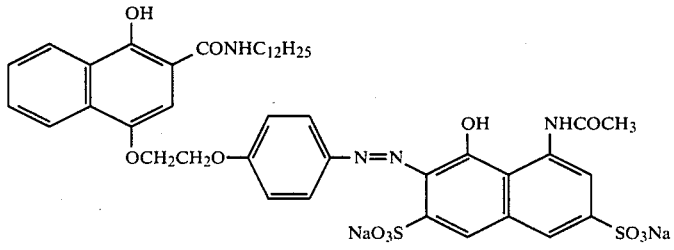
Coupler (EX-5)
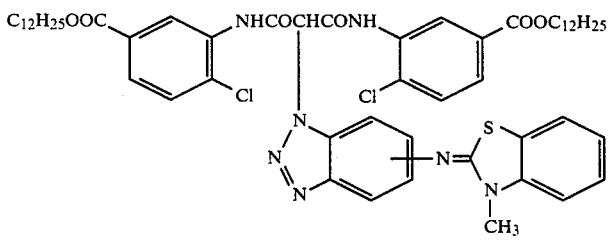
Coupler (EX-6)
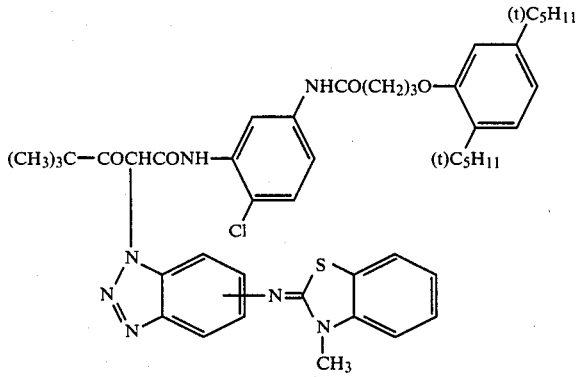
Coupler (EX-7)
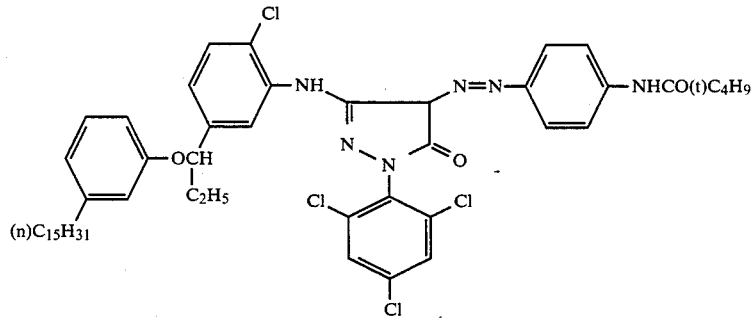
Coupler (EX-8)
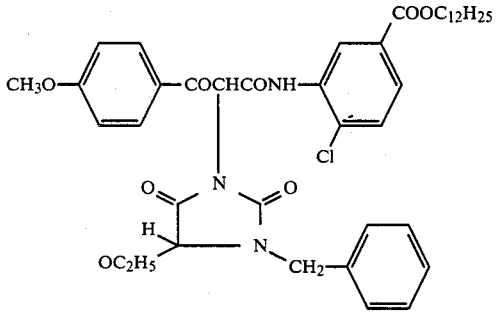
Coupler (EX-9)

-continued

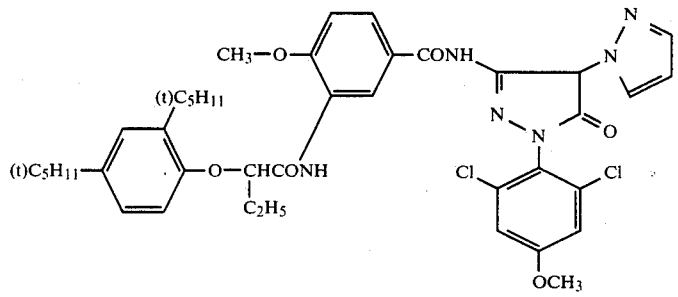

Coupler (EX-10)

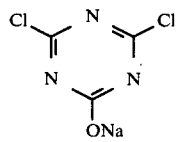

(H-1)

Sample 102 was prepared in the same manner as described for Sample 101 above except for replacing Emulsions A-1, B-1, C-1, D-1, E-1 and F-1 in the 3rd, 4th, 6th, 7th, 9th and 10th layers, respectively, by Emulsions A-2, B-2, C-2, D-2, E-2 and F-2, respectively.

The preparations of Emulsions A-1 to F-1 and A-2 to F-2 were prepared as follows.

An aqueous solution of silver nitrate and an aqueous solution of potassium iodide and potassium bromide were added to a gelatin aqueous solution containing potassium bromide kept at 50° C. while stirring according to a double jet method.

After the addition, soluble salts were removed by a flocculation method. Gelatin was additionally added thereto and dissolved therein, followed by adjustment to a pH of 6.8.

The resulting emulsion was divided into two portions (Emulsion A-1 and Emulsion A-2).

Emulsion A-1 was subjected to gold-sulfur sensitization using sodium thiosulfate, potassium chloroaurate, and potassium thiocyanate under the optimum conditions for the maximum sensitization when fog after the subsequent development processing was 0.01 to prepare Comparative Emulsion A-1.

To Emulsion A-2 was added 3.96 wt% hydrogen peroxide in an amount of 10 ml per mole of silver immediately before the start of gold-sulfur sensitization, and then gold-sulfur sensitization was conducted in the same manner as described above for Emulsion A-1 under the optimum conditions for the sensitization when fog was 0.01 to prepare Emulsion A-2 according to the present invention.

Following the procedure as described above, two types of emulsions (Comparative Emulsions B-1 to F-1 and Emulsions B-2 to F-2 of the present invention) were prepared from the starting emulsions which had been prepared so as to have predetermined halogen contents, average grain sizes, thicknesses and aspect ratios by varying the amount of the potassium iodide solution and the temperature.

Samples prepared as described above were exposed to white light through an optical wedge, and the sensitivities of red sensitive layer, green sensitive layer and blue sensitive layer were compared at an optical density of fog+0.2 as a standard for the determination of sensitivity.

The development processings used in this example were the following steps conducted at 38° C.

| | |
|---|---|
| Color Development | 3 min. 13 sec. |
| Bleaching | 6 min. 30 sec. |
| Rinsing (with water) | 2 min. 10 sec. |
| Fixing | 4 min. 20 sec. |
| Rinsing (with water) | 3 min. 15 sec. |
| Stabilization | 1 min. 0.5 sec. |

The processing solution used at each step was as follows.

| | |
|---|---|
| Color Developer | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1 liter (pH 10.0) |
| Bleaching Solution | |
| Ammonium iron ethylenediamine-tetraacetate | 100.0 g |
| Disodium ethylenediaminetetraacetate | 10.0 g |
| Ammonium Bromide | 150.0 g |
| Ammonium Nitrate | 10.0 g |
| Water to make | 1 liter (pH 6.0) |
| Fixer | |
| Disodium ethylenediaminetetraacetate | 1.0 g |
| Sodium sulfite | 4.0 g |
| Aqueous ammonium thiosulfate (70%) | 175.0 ml |
| Sodium disulfite | 4.6 g |
| Water to make | 1 liter (pH 6.6) |
| Stabilizer | |
| Formalin (40%) | |
| Polyoxyethylene-p-monononylphenyl ether (average degree of polymerization: about 10) | 0.3 g |
| Water to make | 1 liter |

The results obtained are shown in Table 9.

TABLE 9

| Sample | Blue-Sensitive Layer S0.2 (Relative Value) | Green-Sensitive Layer S0.2 (Relative Value) | Red-Sensitive Layer S0.2 (Relative Value) |
|---|---|---|---|
| 101 | 100 | 100 | 100 |

TABLE 9-continued

| Sample | Blue-Sensitive Layer S0.2 (Relative Value) | Green-Sensitive Layer S0.2 (Relative Value) | Red-Sensitive Layer S0.2 (Relative Value) |
|---|---|---|---|
| (Comparative) 102 (Invention) | 185 | 190 | 188 |

As is apparent from Table 9, the relative sensitivity can be markedly increased by using hydrogen peroxide as an oxidizing agent during the chemical ripening of the silver halide emulsion.

While the invention has been described in detail and with reference to specific embodiments thereof, it will be apparent to one skilled in the art that various changes and modifications can be made therein without departing from the spirit and scope thereof.

What is claimed is:

1. A process for producing a substantially surface latent image type silver halide photographic emulsion, comprising the steps of precipitation, physical ripening, washing, and chemical ripening wherein at least one compound selected from hydrogen peroxide or an adduct or precursor thereof is added to an emulsion in the step prior to the end of the chemical ripening step.

2. A process as in claim 1, wherein said compound is added during the precipitation, physical ripening, or chemical ripening step.

3. A process as in claim 1, wherein said compound is added in an amount of from $10^{-6}$ to 10 moles per mole of silver halide.

4. A process as in claim 3, wherein said compound is added in an amount of from $10^{-4}$ to 1 mole per mole of silver halide.

5. A process as in claim 4, wherein said compound is added in an amount of from $10^{-3}$ to 1 mole per mole of silver halide.

6. A process for producing a substantially surface latent image type silver halide photographic emulsion, comprising the steps of precipitation, physical ripening, washing, and chemical ripening steps, wherein at least one compound selected from hydrogen peroxide or an adduct or precursor thereof, a peroxy acid salt, and ozone is added to an emulsion in the step prior to the end of the chemical ripening step, and wherein silver halide grains contained in said emulsion are silver halide tabular grains having an aspect ratio of 3 or more.

7. A process as in claim 6, wherein said silver halide tabular grains have an aspect ratio in the range of from 3 to 50.

8. A process as in claim 6, wherein said silver halide tabular grains having an aspect ratio of 3 or more is present in a proportion of at least 40% by weight based on the total silver halide grains.

9. A process as in claim 1, wherein a chemical sensitizer is used during the chemical ripening step.

10. A process as in claim 9, wherein said chemical sensitizer is a sulfur sensitizer or a gold sensitizer.

11. A process as in claim 9, wherein an auxiliary agent for a gold sensitizer is used.

12. A process as in claim 6, wherein a chemical sensitizer is used during the chemical ripening step.

13. A process as in claim 12, wherein said chemical sensitizer is a sulfur sensitizer or a gold sensitizer.

14. A process as in claim 12, wherein an auxiliary agent for a gold sensitizer is used.

15. A process as in claim 6, wherein said silver halide emulsion is spectrally sensitized with a sensitizing dye.

16. A process as in claim 1, wherein said silver halide emulsion is spectrally sensitized with a sensitizing dye.

17. A process as in claim 16, wherein said sensitizing dye is a cyanine dye, a merocyanine dye or a complex cyanine dye.

18. A process as in claim 16, wherein said sensitizing dye is used after addition of hydrogen peroxide.

19. A substantially latent image type silver halide photographic emulsion, which is produced by a process comprising the steps of precipitation, physical ripening, washing, and chemical ripening, wherein at least one compound selected from hydrogen peroxide or an adduct or precursor thereof, a peroxy acid salt, and ozone is added to an emulsion in the step prior to the end of the chemical ripening step, and wherein silver halide grains contained in said emulsion are silver halide tabular grains having an aspect ratio of 3 or more.

20. An emulsion as in claim 19, wherein said silver halide tabular grains have an aspect ratio in the range of from 3 to 50.

21. An emulsion as in claim 19, wherein said silver halide tabular grains having an aspect ratio of 3 or more is present in a proportion of at least 40% by weight based on the total silver halide grains.

22. A process as in claim 6, wherein said compound is added in an amount of from $10^{-6}$ to 10 moles per mole of silver halide.

23. A process as in claim 6, wherein said compound is added in an amount of from $10^{-4}$ to 1 mole per mole of silver halide.

24. A process as in claim 6, wherein said compound is added in an amount of from $10^{-3}$ to 1 mole per mole of silver halide.

25. A process as in claim 15, wherein said sensitizing dye is a cyanine dye, a merocyanine dye or a complex cyanine dye.

26. A process as in claim 6, wherein said compound is added during the precipitation, physical ripening, or chemical ripening step.

27. An emulsion as in claim 19, wherein said compound is added in an amount of from $10^{-6}$ to 10 moles per mole of silver halide.

28. An emulsion as in claim 19, wherein a chemical sensitizer is used during the chemical ripening step.

29. An emulsion as claimed in claim 28, wherein said chemical sensitizer is a sulfur sensitizer or a gold sensitizer.

30. An emulsion as claimed in claim 29, wherein an auxilliary agent for a gold sensitizer is used.

31. An emulsion as claimed in claim 19, wherein said silver halide emulsion is spectrally sensitized with a sensitizing dye.

32. An emulsion as claimed in claim 31, wherein said sensitizing dye is a cyanine dye, a merocyanine dye or a complex cyanine dye.

33. An emulsion as claimed in claim 31, wherein said sensitizing dye is used after addition of hydrogen peroxide, peroxy acid salt or ozone.

* * * * *